US009879431B2

(12) United States Patent
Keene

(10) Patent No.: US 9,879,431 B2
(45) Date of Patent: Jan. 30, 2018

(54) ROOF VENTING MATERIAL, SYSTEM, AND METHOD

(71) Applicant: Keene Building Products Co., Inc., Mayfield Heights, OH (US)

(72) Inventor: James R. Keene, Pepper Pike, OH (US)

(73) Assignee: Keene Building Products Co., Inc., Mayfield Heights, OH (US)

( * ) Notice: Subject to any disclaimer, the term of this patent is extended or adjusted under 35 U.S.C. 154(b) by 0 days.

(21) Appl. No.: 14/972,394

(22) Filed: Dec. 17, 2015

(65) Prior Publication Data

US 2016/0177573 A1 Jun. 23, 2016

Related U.S. Application Data

(60) Provisional application No. 62/092,868, filed on Dec. 17, 2014.

(51) Int. Cl.
*E04D 13/17* (2006.01)
*E04D 13/076* (2006.01)

(52) U.S. Cl.
CPC ..... *E04D 13/178* (2013.01); *E04D 13/076* (2013.01)

(58) Field of Classification Search
CPC ..... E04D 13/178
See application file for complete search history.

(56) References Cited

U.S. PATENT DOCUMENTS 3,056,005 A * 9/1962 Larson ..... H01H 3/141 200/86 R
3,082,611 A * 3/1963 Alvis ..... B64D 13/006 165/133
3,507,738 A * 4/1970 Prusinski ..... B29C 39/00 156/242
4,055,925 A * 11/1977 Wasserman ..... E04D 13/151 428/468
4,514,197 A * 4/1985 Armbruster ..... B01D 46/10 55/385.2
5,364,458 A * 11/1994 Burnett ..... B03C 3/155 55/496
5,804,762 A * 9/1998 Jones ..... H05K 9/0015 174/358

(Continued)

FOREIGN PATENT DOCUMENTS

CA 2756301 A1 * 7/2012 ..... B32B 3/06
CN 201087504 Y * 7/2008

(Continued)

*Primary Examiner* — Jeanette E Chapman
(74) *Attorney, Agent, or Firm* — Renner, Otto, Boisselle & Sklar, LLP

(57) ABSTRACT

The present disclosure provides a venting material that includes a web of extruded polymer monofilaments covered by a screen. The polymer monofilaments are heat welded at junctions to form a matrix of tangled monofilaments. The web allows for direct pathways for ventilation without the issues of clogging or ice dams. The screen allows for air passage while providing a barrier for insects and other outside elements. The venting material may be included in a roof ventilation system between vertical side walls and a fascia of a building. The venting material may be installed between vertical side walls and a fascia of a building as a method for ventilating a roof of the building.

9 Claims, 3 Drawing Sheets

(56) References Cited

U.S. PATENT DOCUMENTS

| | | | | |
|---|---|---|---|---|
| 5,918,425 | A * | 7/1999 | Archard | E04D 13/178 52/199 |
| 7,073,306 | B1 * | 7/2006 | Hagaman | E04B 1/35 249/20 |
| 8,205,398 | B2 * | 6/2012 | Chich | E04D 13/152 52/302.3 |
| 8,973,310 | B1 * | 3/2015 | Henderson | E04D 13/178 52/302.1 |
| 2009/0007508 | A1 * | 1/2009 | Dunstan | E04B 1/70 52/302.1 |
| 2011/0107700 | A1 * | 5/2011 | Keene | B32B 5/12 52/403.1 |
| 2011/0217539 | A1 * | 9/2011 | Bonner | B01D 67/0006 428/314.2 |
| 2016/0093881 | A1 * | 3/2016 | Schroedle | C01G 53/006 429/221 |

FOREIGN PATENT DOCUMENTS

| | | | | |
|---|---|---|---|---|
| CN | 204475651 | U * | 7/2015 | |
| FR | 2952078 | A1 * | 5/2011 | E02D 29/0208 |

* cited by examiner

ROOF VENTING MATERIAL, SYSTEM, AND METHOD

This application claims the benefit under 35 U.S.C. §119 (e) to U.S. Provisional Application No. 62/092,868 filed on Dec. 17, 2014. The application is incorporated herein by reference in its entirety.

FIELD OF INVENTION

The present invention relates generally to roof ventilation, and more particularly to a roof venting material, system, and method that includes a web of extruded polymer monofilaments and a screen.

BACKGROUND

Conventional eave ventilation is made from sheets of metal stamped with vents cut and shaped to allow air to pass through. The installation of these metal vents is expensive and time consuming because these vents have to be added after the eave is built or requires special material built into the sheathing. Additionally, the metal vent does not connect with the air passage way that is often installed as a chute made form impermeable sheets of plastic.

Moreover, ice dams are created when heat escapes from the living area or is passed through conduction to the attic. The heat then warms the surface of the roof and melts any snow that might accumulate. The interior warmth is exacerbated warming the area at the edge of the roof. The area just above is a little colder. That creates a dam at the edge of the roof. The gutter accumulates water, which results in another cold area. The space between warms the snow to a liquid and traps it. This trapped water can lead back into the occupied space.

SUMMARY

The present disclosure provides a roof venting material, system, and method that provides ventilation for a roof while further providing simpler ventilation installation and prevention of ice dams. The venting material provided by the invention includes a web of extruded polymer monofilaments covered with a screen. The polymer monofilaments are heat welded at junctions to form a matrix of tangled monofilaments. The roof ventilation system and method provided by the invention includes a web of extruded polymer monofilaments between vertical side walls and a fascia of a building.

In accordance with one aspect of the present disclosure, a venting material includes: a web of extruded polymer monofilaments, the polymer monofilaments being heat welded at junctions to form a matrix of tangled monofilaments, the web having opposite major surfaces and a pair of opposed edges connecting the major surfaces; and a screen covering one of the edges and extending onto and overlying parts of each of the major surfaces.

In one embodiment, the polymer monofilaments are made of a material selected from polyolefin, polyamide, polyester, polyvinylhalide, polystyrene, polyvinylester, or a mixture of two or more thereof.

In another embodiment, the polymer monofilaments are made of a material selected from polyethylene, polypropylene, or a mixture thereof.

In another embodiment, the polymer monofilaments have an average diameter in the range from 1 mil to 4 mils.

In another embodiment, the screen is made of a material selected from aluminum, copper, bronze, plastic, polyester, fiberglass, or a mixture of two or more thereof.

In another embodiment, the screen has interwoven strands woven to form screen openings.

In another embodiment, the interwoven strands include a first set of strands extending in a first direction and a second set of strands extending in a second direction, the second direction being orthogonal to the first direction.

In another embodiment, the screen is secured to the web with fasteners.

In another embodiment, the venting material is a roll material.

In accordance with another aspect of the present disclosure, a roof ventilation system includes: vertical side walls having a top portion; a roof extending outwardly and beyond the vertical side walls; a fascia extending downwardly from the portion of the roof that extends past the top portion of the vertical side walls; and a web of extruded polymer monofilaments, the polymer monofilaments being heat welded at junctions to form a matrix of tangled monofilaments, the web having opposite major surfaces and a pair of opposed edges connecting the major surfaces, one of the major surfaces facing the vertical side walls and another one of the major surfaces facing the fascia.

In another embodiment, a screen covers one of the edges of the web and extends onto and overlies parts of each of the major surfaces of the web.

In another embodiment, the web is positioned such that the screen is exposed to the outside elements.

In another embodiment, one of the edges contacts the roof.

In another embodiment, the web is secured to the vertical side walls and/or fascia with penetrating fasteners.

Another embodiment includes a gutter that is farther than the fascia from the vertical side walls.

In another embodiment, the gutter is attached to the side of the fascia facing away from the vertical side walls.

In another embodiment, the web further extends between the roof and the fascia and over the gutter.

In another embodiment, the web further extends between the roof and the fascia and between the gutter and the fascia.

In accordance with another aspect of the present disclosure, a method for ventilating a roof of a building includes: installing a web of extruded polymer monofilaments between vertical side walls and a fascia of the building, the polymer monofilaments being heat welded at junctions to form a matrix of tangled monofilaments, and the web having opposite major surfaces and a pair of opposed edges connecting the major surfaces, wherein: the vertical side walls have a top portion; the roof extends outwardly and beyond the vertical side walls; and the fascia extends downwardly from the portion of the roof that extends past the top portion of the vertical side walls.

In one embodiment, the web is a roll material installed by rolling out the web such that one of the major surfaces contacts the vertical side walls; and sliding the web into a cavity formed by the roof, fascia, and vertical side walls.

The foregoing and other features of the invention are hereinafter described in greater detail with reference to the accompanying drawings.

DETAILED DESCRIPTION

Figure 1:
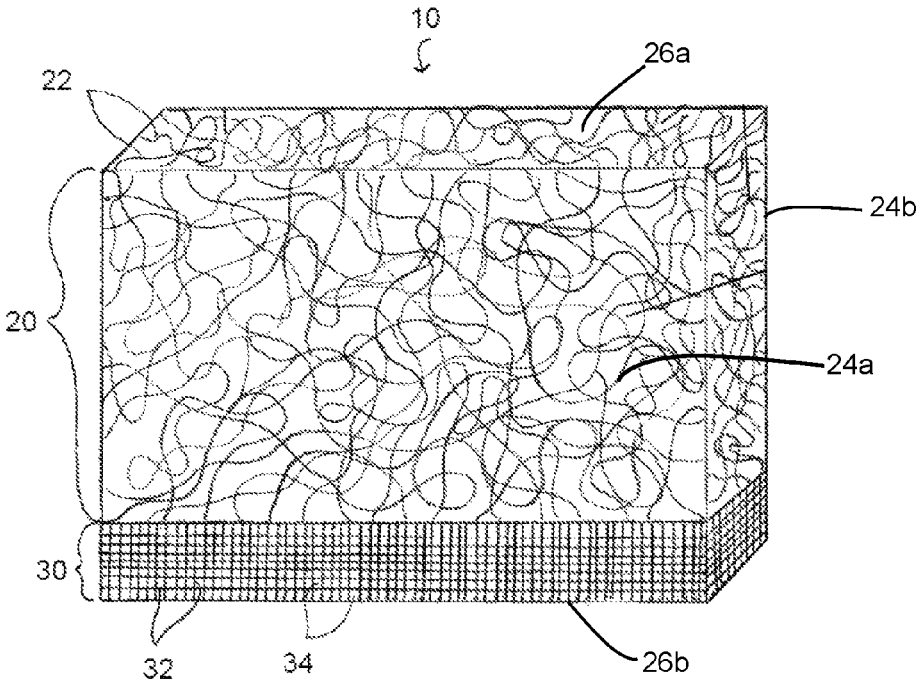
FIG. 1 is an oblique view of an exemplary venting material for venting a roof according to the disclosure.

In the description that follows, like components have been given the same reference numerals, regardless of whether they are shown in different embodiments. To illustrate an embodiment(s) of the present disclosure in a clear and concise manner, the drawings may not necessarily be to scale and certain features may be shown in somewhat schematic form. Features that are described and/or illustrated with respect to one embodiment may be used in the same way or in a similar way in one or more other embodiments and/or in combination with or instead of the features of the other embodiments.

An exemplary venting material includes a web of extruded polymer monofilaments covered by a screen. The polymer monofilaments are heat welded at junctions to form a matrix of tangled monofilaments. The web allows for direct pathways for ventilation without the issues of clogging or ice dams. The screen allows for air passage while providing a barrier for insects and other outside elements. The venting material may be included in a roof ventilation system between vertical side walls and a fascia of a building. The venting material may be installed between vertical side walls and a fascia of a building as a method for ventilating a roof of the building.

Referring now in detail to the drawings, and initially to FIG. 1, a venting material is shown at 10. The depicted venting material 10 includes a web 20 of extruded polymer monofilaments 22. The monofilaments 22 are heat welded at junctions to form a matrix of tangled monofilaments 22. The monofilaments 22 of the web 20 may be made from any thermoplastic polymer that provides the desired properties of strength and resilience when included in the venting material 10. The monofilaments 22 may be made of polyolefin (e.g., polyethylene, polypropylene, etc.), polyamide (e.g., Nylon), polyester, polyvinylhalide (e.g., polyvinylchloride (PVC), polyvinylidene chloride, polyvinyltetrafluoride, or polyvinylchlorotrifluoride), polystyrene, polyvinylester (e.g., polyvinyl acetate, etc.), or a mixture of two or more thereof.

The monofilaments 22 are extruded onto a substrate having the desired structural profile to form the web 20. The monofilaments 22 of the web 20 may form a peak and valley structure undulating in the longitudinal and/or traverse directions, preferably to provide a waffle-like structure. Due to its filamentatious structure, the web 20 contains a great number of mutually interconnected voids that allow gases and liquid to flow freely therethrough.

In one example, the monofilaments 22 may have an average diameter in the range of 0.25 mils to 6 mils, or in another example in the range of 0.50 mils to 5 mils, or in another example in the range of 0.75 mils to 4.5 mils, or in another example in the range of 1 mil to 4 mils.

As shown, the web 20 has opposite major surfaces 24*a*, 24*b* and a pair of opposed edges 26*a*, 26*b* connecting the major surfaces 24*a*, 24*b* to form a shape with a rectangular cross section. However, the web 20 may be any suitable shape that provides for proper ventilation of a roof without the issues of clogging or ice dams, such as a pyramid, prism, cylinder, or sphere.

As depicted, the venting material 10 includes a screen 30 covering one of the edges 26*a*, 26*b* and extending onto and overlying parts of each of the major surfaces 24*a*, 24*b*. The screen 30 may be made of a material selected from aluminum, copper, bronze, plastic, polyester, fiberglass, or a mixture of two or more thereof.

As shown, the screen 30 has interwoven strands 32 woven to form screen openings 34. The interwoven strands 32 include a first set of strands extending in a first direction and a second set of strands extending in a second direction, the second direction being orthogonal to the first direction. As depicted, the openings 34 have a rectangular shape, but may any suitable shape to allow air passage while providing an insect barrier, such as circular or triangular.

The term "mesh size" refers to the amount of openings 34 in one inch of screen 30. In one example, the mesh size of the screen 30 in the first direction and/or the second direction may be in the range of 14 openings to 30 openings, or in another example in the range of 16 openings to 28 openings, or in another example in the range of 18 openings to 26 openings, or in another example in the range 20 openings to 24 openings.

In one example, the strands 32 may have an average diameter in the range of 5 mils to 50 mils, or in another example in the range of 10 mils to 45 mils, or in another example in the range of 20 mils to 40 mils, or in another example in the range of 25 mils to 35 mils.

While the screen 30 is shown secured to the web 20 without the use of fasteners, the screen 30 may be secured to the web 20 with fasteners. The fasteners may include adhesive, staples, nails, ties, clips, or a mixture of two or more thereof.

In one example, the thickness of the venting material 10 may be in the range of 0.1 inches to 10 inches, or in another example in the range of 0.1 inches to 5 inches, or in another example in the range of 0.25 inches to 2.5 inches, or in another example in the range of 0.25 inches to 1 inch. In one example the venting material 10 may have a height in the range of 1 inch to 15 inches, or in another example in the range of 2 inches to 13 inches, or in another example in the range of 3 inches to 11 inches, or in another example in the range of 4 inches to 10 inches.

Figure 2:
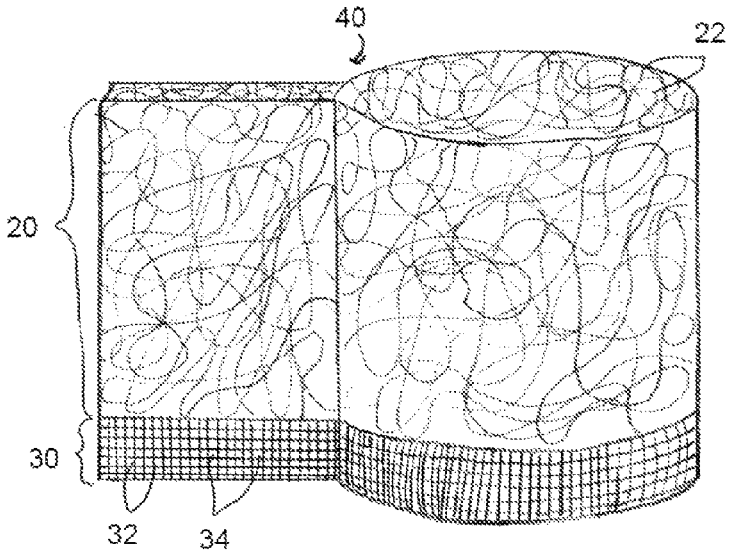
FIG. 2 is an oblique view of the venting material of FIG. 1 as roll material.

Referring now to FIG. 2, the venting material 10 (FIG. 1) is a roll material 40. The roll material 40 may include venting material 10 that is rolled onto itself around an axis. The roll material 40 provides for easier installation of the venting material 10.

In one example, the thickness of the roll material 40 may be in the range of 0.1 inches to 10 inches, or in another example in the range of 0.1 inches to 5 inches, or in another example in the range of 0.25 inches to 2.5 inches, or in another example in the range of 0.25 inches to 1 inch. In one example the roll material 40 may have a height in the range of 1 inch to 15 inches, or in another example in the range of 2 inches to 13 inches, or in another example in the range of 3 inches to 11 inches, or in another example 4 inches to 10 inches. In one example, the roll material 40 may have a length of 1 foot to 35 feet, or in another example in the range of 5 feet to 30 feet, or in another example in the range of 10 feet to 25 feet, or in another example in the range of 15 feet to 20 feet.

Figure 3:
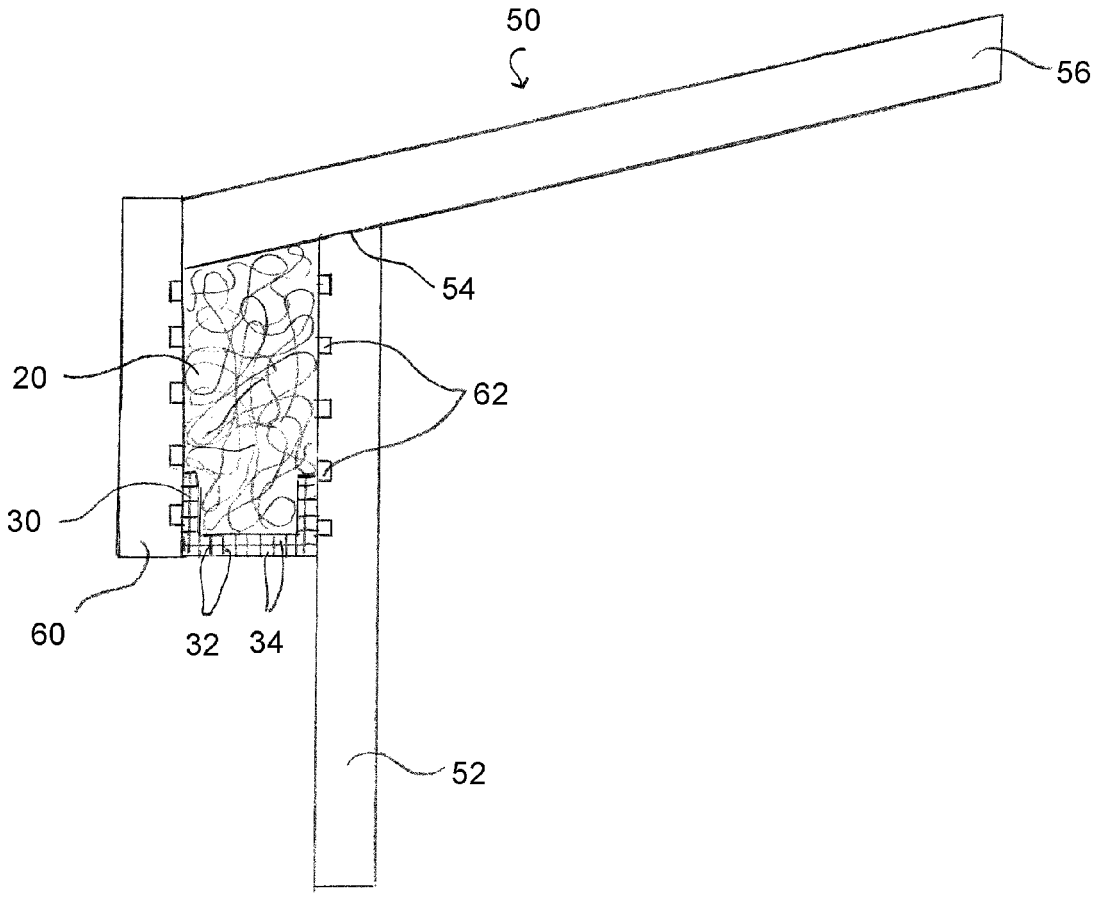
FIG. 3 is a cross-sectional view of an exemplary roof ventilation system according to the disclosure.

Turning now to FIG. 3, a roof ventilation system is shown at 50. The roof ventilation system 50 includes vertical side walls 52 having a top portion 54. The vertical side walls 52 may be generally constructed of a frame (not shown), a sheathing (not shown), and an external wall covering (not shown).

As depicted, a roof 56 extends outwardly and beyond the vertical side walls 52. While the roof 56 is shown sloped at an angle relative to the vertical side walls 52, the roof 56 may be orthogonal relative to the vertical side walls 52.

In some embodiments, the roof 56 includes rafters (not shown), sheathing (not shown), a water-proof membrane (not shown), and shingles (not shown). The rafters may include a series of sloped beams that extend from the vertical side walls 52. The sheathing may be secured to the side of the rafters facing away from the vertical side walls 52. The sheathing may be made of wood, plywood, oriented-strand board, fiberboard, foam, gypsum board, cardboard, or a mixture of two or more thereof. The membrane may be secured to the side of the sheathing facing away from the vertical side walls 52. The membrane may be made of rubber, polyvinyl chloride, bitumen, or a mixture of two or more thereof. The shingles may be secured to the side of the membrane facing away from the vertical side walls 52. The shingles may be made of wood, slate, flagstone, fibre cement, metal, plastic, composite material, or a mixture of two or more thereof.

As depicted, a fascia 60 extends downwardly from the portion of the roof 56 that extends past the top portion 54 of the vertical side walls 52. While the fascia 60 is shown connected to the roof 56 on a side of the roof 56 that is parallel to the vertical side walls 52, the fascia 60 may be connected to the roof 56 on a side of the roof 56 that is facing the vertical side walls 52.

As depicted, one of the major surfaces 24*a*, 24*b* (FIG. 1) faces the vertical side walls 52 and the other one of the major surfaces 24*a*, 24*b* faces the fascia 60. While one of the major surfaces 24*a*, 24*b* is shown contacting the vertical side walls 52 and the other one of the major surfaces 24*a*, 24*b* is shown contacting the fascia 60, the web 20 need not contact the fascia 60 or the vertical side walls 52. Thus, a cavity may be formed between the fascia 60 and the web 20 and/or the web 20 and the vertical side walls 52. Moreover, while one of the major surfaces 24*a*, 24*b* is shown contacting the roof 56, the web 20 need not contact the roof 56 and a cavity may be formed between the web 20, the roof 56, the fascia 60, and the vertical side walls 52.

As depicted, the web 20 is positioned such that the screen 30 is exposed to the outside elements. The screen 30 is in physical contact with the fascia 60 and the vertical side walls 52. In some embodiments, the web 20 is secured to the vertical side walls 52 and/or fascia 60 with penetrating fasteners 62. The penetrating fasteners 62 may be nails or staples.

Figure 4:
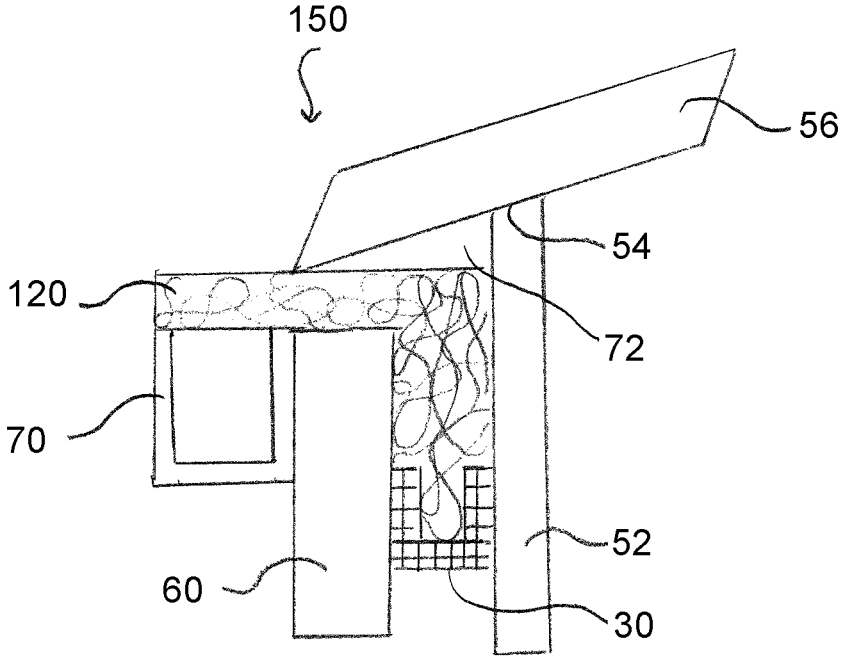
FIG. 4 is a cross-sectional view of an embodiment of the roof ventilation system.

Referring now to FIG. 4 the roof ventilation system 150 includes a gutter 70 that is farther than the fascia 60 from the vertical side walls 52. The gutter 70 may be made from cast iron, lead, zinc, galvanized steel, painted steel, copper, painted aluminum, vinyl, concrete, stone, wood, or a mixture of two or more thereof.

While the gutter 70 is shown attached to the side of the fascia 60 facing away from the vertical side walls 52, the gutter 70 may be attached to the side of the fascia 60 facing the roof 56 or to the side of the fascia 60 facing away from the roof 56.

As shown, a web 120 further extends between the roof 56 and the fascia 60 and over the gutter 70. By extending the web 120 over the top of a gutter 70, the web 120 acts as a drainage device for moisture that might back up from the gutter 70. Relieving moisture from accumulating on side of the roof 56 facing away from the vertical side walls 52 would assist in controlling ice dam formation.

Figure 5:
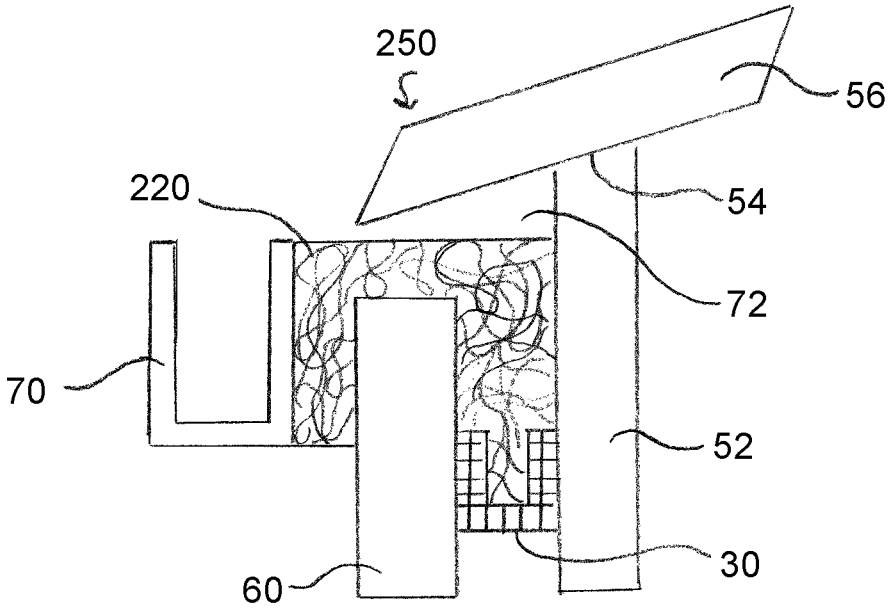
FIG. 5 is a cross-sectional view of another embodiment of the roof ventilation system.

Turning now to FIG. 5, the roof ventilation system 250 includes a web 220 further extends between the roof 56 and the fascia 60 and between the gutter 70 and the fascia 60. As shown, the gutter 70 contacts the web 220 on a side facing away from the vertical side walls 52. This embodiment allows the web 220 to act as a gutter guard against the fascia 60 by preventing debris from building up behind the gutter 70.

In some embodiments, a method for ventilating a roof of a building includes installing a web 20 of extruded polymer monofilaments 22 between vertical side walls 52 and a fascia 60 of the building. The web 20 may be a roll material 40 installed by rolling out the web 20 such that one of the major surfaces 24*a*, 24*b* contacts the vertical side walls 52 and sliding the web 20 into a cavity 72 formed by the roof 56, fascia 60, and vertical side walls 52. The web 20 may be installed before the fascia 60 is added because the web 20 may be attached to the vertical side walls 52.

In other embodiments, the web 20 is made in connection with a chute vent that is installed with insulation. Chute vents are used to keep air flowing through the attic or top of the house. Their primary purpose is to keep insulation from clogging lower ventilation (i.e., the web 20). Chute vents may extend from the vertical side walls 52 along the side of the roof 56 facing the vertical side walls 52. Before the chute vent is installed, web 20 may be installed below the area where the chute vent is installed.

The present disclosure provides a roof venting material, system, and method that provides ventilation for a roof while further providing a barrier for insects and other outside elements. The venting material 10 provided by the invention includes a web 20 of extruded polymer monofilaments 22 covered with a screen 30. The polymer monofilaments 22 are heat welded at junctions to form a matrix of tangled monofilaments 22. The roof ventilation system 50 and method provided by the invention includes a web 20 of extruded polymer monofilaments 22 between vertical side walls 52 and a fascia 60 of a building.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A venting material comprising:

a web of extruded polymer monofilaments, the polymer monofilaments being heat welded at junctions to form a matrix of tangled monofilaments, the web having opposite exterior major surfaces and a pair of opposed exterior edges connecting the exterior major surfaces; and a screen overlying only a portion of one of the exterior major surfaces, the screen extending onto and wrapping one of the exterior edges, and the screen extending onto and overlying the other of the exterior major surfaces.

2. The venting material of claim 1, wherein the polymer monofilaments are made of a material selected from polyolefin, polyamide, polyester, polyvinylhalide, polystyrene, polyvinylester, or a mixture of two or more thereof.

3. The venting material of claim 1, wherein the polymer monofilaments are made of a material selected from polyethylene, polypropylene, or a mixture thereof.

4. The venting material of claim 1, wherein the polymer monofilaments have an average diameter in the range from 1 mil to 4 mils.

5. The venting material of claim 1, wherein the screen is made of a material selected from aluminum, copper, bronze, plastic, polyester, fiberglass, or a mixture of two or more thereof.

6. The venting material of claim 1, wherein the screen has interwoven strands woven to form screen openings.

7. The venting material of claim 6, wherein the interwoven strands comprise a first set of strands extending in a first direction and a second set of strands extending in a second direction, the second direction being orthogonal to the first direction.

8. The venting material of claim 1, wherein the screen is secured to the web with fasteners.

9. The venting material of claim 1, wherein the venting material is a roll material.

* * * * *